US009539163B2

(12) United States Patent
Goldman et al.

(10) Patent No.: US 9,539,163 B2
(45) Date of Patent: Jan. 10, 2017

(54) ADJUSTABLE MOBILITY ASSISTIVE DEVICE

(71) Applicant: Demilune, Inc., Los Angeles, CA (US)

(72) Inventors: Noah Goldman, Los Angeles, CA (US); Robin Parrish, Carlsbad, CA (US); Geonyoung Kim, Rohnert Park, CA (US); Andrea Dickey, San Jose, CA (US)

(73) Assignee: Demilune, Inc., Los Angeles, CA (US)

( * ) Notice: Subject to any disclaimer, the term of this patent is extended or adjusted under 35 U.S.C. 154(b) by 0 days.

(21) Appl. No.: 14/696,343

(22) Filed: Apr. 24, 2015

(65) Prior Publication Data

US 2015/0305963 A1 Oct. 29, 2015

Related U.S. Application Data

(60) Provisional application No. 61/984,729, filed on Apr. 25, 2014.

(51) Int. Cl.

| | |
|---|---|
| ***A61H 3/04*** | (2006.01) |
| ***A61H 3/00*** | (2006.01) |
| ***A61G 5/02*** | (2006.01) |

(52) U.S. Cl.

CPC *A61H 3/00* (2013.01); *A61G 5/02* (2013.01); *A61H 3/04* (2013.01); *A61H 2003/043* (2013.01)

(58) Field of Classification Search

CPC ..... A61H 3/00; A61H 3/04; A61H 3/008; A61H 2003/046; A63B 22/00; A61G 5/02

USPC ..... 135/66–67, 85; 297/5–9, 2; 280/87.041, 280/87.051, 87.021; 482/67–68

See application file for complete search history.

(56) References Cited

U.S. PATENT DOCUMENTS

| | | | | | |
|---|---|---|---|---|---|
| 320,462 | A * | 6/1885 | Cowing | A63B 69/0022 | 482/68 |
| 2,577,034 | A * | 12/1951 | Quinlan | E06B 9/02 | 160/217 |
| 3,195,550 | A * | 7/1965 | Ingalls | A61H 3/04 | 135/67 |
| 4,244,302 | A * | 1/1981 | Stine | E05G 5/02 | 109/2 |
| 4,272,071 | A * | 6/1981 | Bolton | A61H 3/04 | 135/67 |
| 5,040,556 | A * | 8/1991 | Raines | A61H 3/00 | 135/67 |
| 5,123,665 | A * | 6/1992 | Levy | B62B 3/022 | 211/201 |
| 5,228,708 | A * | 7/1993 | Verdugo | A61H 3/04 | 135/67 |

(Continued)

*Primary Examiner* — Winnie Yip
(74) *Attorney, Agent, or Firm* — Kwan & Olynick LLP

(57) ABSTRACT

Provided are mechanisms and processes for an adjustable mobility assistive device. In various examples, the adjustable mobility assistive device includes a first frame including a slotted rail S1 and a slotted rail S3 coupled by post P1 and post P3. Both slotted rail S1 and slotted rail S3 may be quarter circular in shape. The adjustable mobility assistive device also includes a second frame including a slotted rail S2 and a slotted rail S4 coupled by post P2 and post P4. Both slotted rail S2 and slotted rail S4 may be quarter circular in shape. Post P2 is slidably connected to slotted rail S1 and slotted rail S3, and post P3 is slidably connected to slotted rail S2 and slotted rail S4. Post P2 is adjacent to post P3 when in a fully extended position and post P1 is adjacent to post P2 and post P3 is adjacent to post P4 in a retracted position.

20 Claims, 11 Drawing Sheets

(56) References Cited

U.S. PATENT DOCUMENTS

| | | | | |
|---|---|---|---|---|
| D420,624 | S * | 2/2000 | Gonzalez | D12/130 |
| 6,112,460 | A * | 9/2000 | Wagnitz | E06B 9/04 49/394 |
| 7,226,396 | B2 * | 6/2007 | Buechel, Jr. | A63B 3/00 482/148 |
| 7,669,863 | B2 * | 3/2010 | Steiner | A61G 5/14 280/250.1 |
| 8,967,642 | B2 * | 3/2015 | Bagheri | A61G 5/1002 135/67 |
| 2015/0224014 | A1 * | 8/2015 | Cook | A61H 3/04 280/657 |

* cited by examiner

ADJUSTABLE MOBILITY ASSISTIVE DEVICE

CROSS REFERENCE TO RELATED APPLICATIONS

This application claims priority under 35 U.S.C. §119(e) to U.S. Provisional Application No. 61/984,729, filed Apr. 25, 2014, entitled ADJUSTABLE MOBILITY ASSISTIVE DEVICE, the contents of each of which are hereby incorporated by reference.

FIELD OF THE INVENTION

Mechanisms and processes are described relating to an adjustable mobility assistive device.

BACKGROUND

One in three adults over the age of 65 years of age fall each year. These falls result in fractures, decreased mobility, fear and trauma. Less than 3% of fall related injuries treated in the ER occur while using a cane or walker (Stevens 2009). In a study by Roelands et al. conducted in a nursing facility, despite the fact that 74% of those in the study were prescribed assistive devices, only 21% of falls occurred while using devices (Roelands 2002). It can therefore be gathered that many falls among the elderly occur when an individual is not using his or her device.

The chance of falling significantly increases when these users forgo their devices, as the 30-50% of users who abandon their prescribed walkers represents a highly disproportionate number of at home falls (Roelands 2002). Furthermore, even those elderly who do use their mobility assistive devices will often leave behind their device to maneuver through tighter spaces in the home, such as kitchens, hallways, and bathrooms (Theresa et al. 2013). They may find their assistive device too "clunky" or simply admit to leaving it "in the wrong part of the house" (Iezzoni 2003). Some individuals will instead choose to "furniture surf," a behavior in which the user will use furniture in the room to maintain balance, moving their hands from furniture item to furniture item as they move through the space (Theresa et al. 2013 and Iezzoni 2009).

Current devices are not effective enough at preventing falls during use. In particular, if a device could be more easily and conveniently taken throughout the entirety of an individual's home and through tight spaces, they would be more likely to use the device at all or most times, subsequently decreasing their chance of falling. Accordingly, there is a need for a device that operates throughout many environments, such as the home and tight spaces.

Overview

Provided are mechanisms and processes for an adjustable mobility assistive device. In various examples, the adjustable mobility assistive device includes a first frame including a slotted rail S1 and a slotted rail S3 coupled by post P1 and post P3. Both slotted rail S1 and slotted rail S3 may be curved in shape. The adjustable mobility assistive device also includes a second frame including a slotted rail S2 and a slotted rail S4 coupled by post P2 and post P4. Both slotted rail S2 and slotted rail S4 may be curved in shape. Post P2 is slidably connected to slotted rail S1 and slotted rail S3, and post P3 is slidably connected to slotted rail S2 and slotted rail S4. Post P2 is adjacent to post P3 when in a fully extended position and post P1 is adjacent to post P2 and post P3 is adjacent to post P4 in a retracted position.

These and other embodiments are described further below with reference to the figures.

DETAILED DESCRIPTION OF EXAMPLE EMBODIMENTS

In the following description, numerous specific details are set forth in order to provide a thorough understanding of the presented concepts. The presented concepts may be practiced without some or all of these specific details. In other instances, well known process operations have not been described in detail so as to not unnecessarily obscure the described concepts. While some concepts will be described in conjunction with the specific embodiments, it will be understood that these embodiments are not intended to be limiting.

Many falls among the elderly occur when a user is not using their prescribed mobility assistive device, such as a walker or cane. In particular, 30-50% of users who abandon their prescribed mobility assistive device represents a highly disproportionate number of at home falls. Furthermore, even those elderly who do use their mobility assistive devices will often leave behind their devices to maneuver through tighter spaces in the home, such as kitchens, hallways, and bathrooms.

Accordingly, there is a need to provide a mobility assistive device that can more easily and conveniently be taken throughout many environments of the home, and into tight spaces within or outside the home. Such an improved mobility assistive device may encourage users to use the device more constantly, subsequently decreasing their chance of falling. To address these needs, various mechanisms and processes described herein relate to an adjustable mobility assistive device that can be maneuvered throughout many environments of the home and outside of the home.

In various example embodiments, an adjustable mobility assistive device provides numerous advantages and attributes such as: 1) the device operates throughout many environments of the home, 2) the device operates with minimal input from the user, 3) the device is comfortable during use, 4) the device is easy to transport and store, and 5) the device is quick and easy to set up. Because there is a tradeoff between stability and portability, the adjustable mobility assistive device provides a balance between these two factors. Specifically, a device with a larger base is more stable but more likely to be temporarily abandoned when the user is entering a tight space. Consequently, various embodiments of the adjustable mobility assistive device described herein provide an adjustable footprint in order to provide both stability and portability.

System Examples

Figure 1:
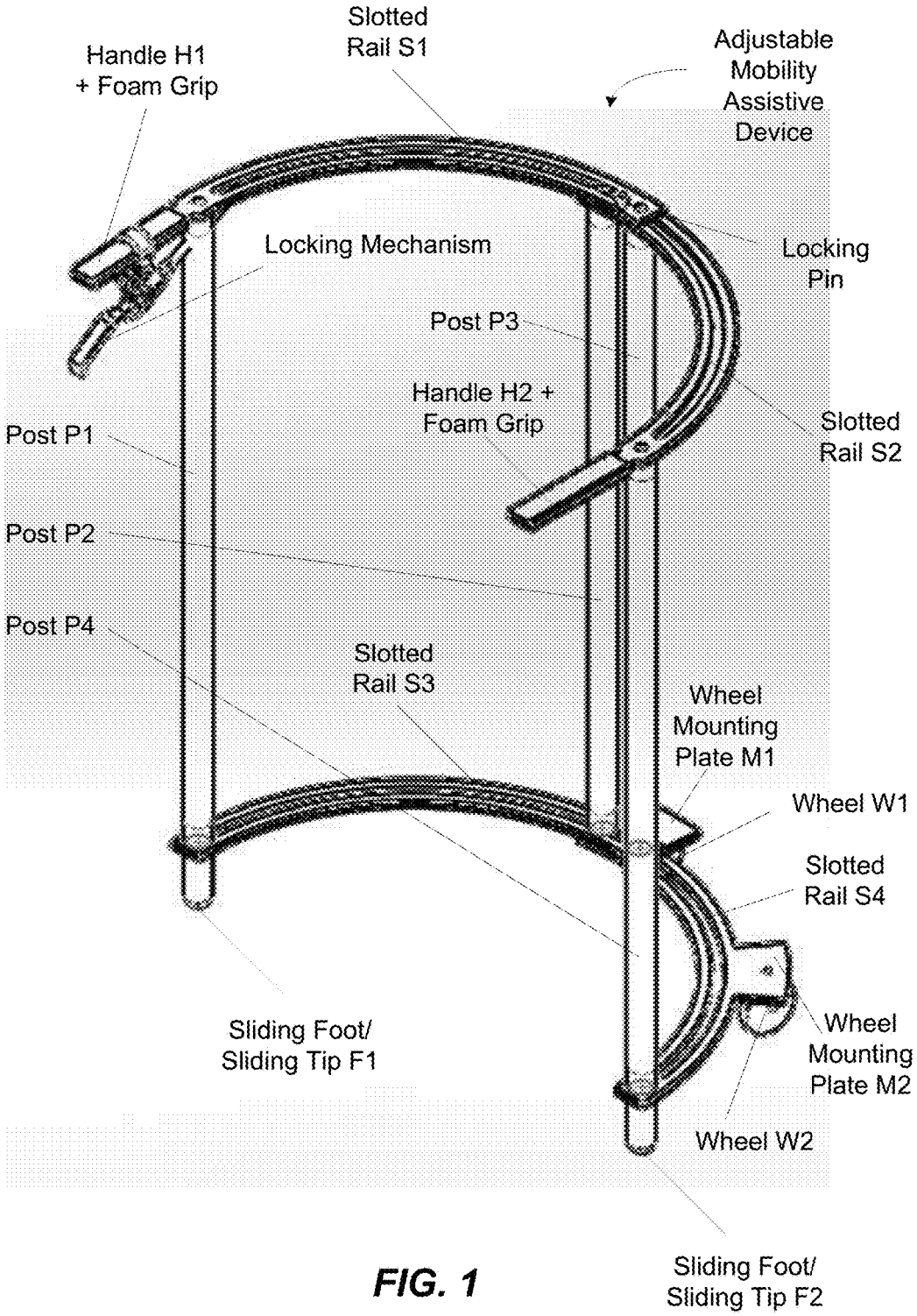
FIG. 1 is a diagrammatic representation of one example of an adjustable mobility assistive device in a fully extended position, in accordance with various embodiments.
Figure 2:
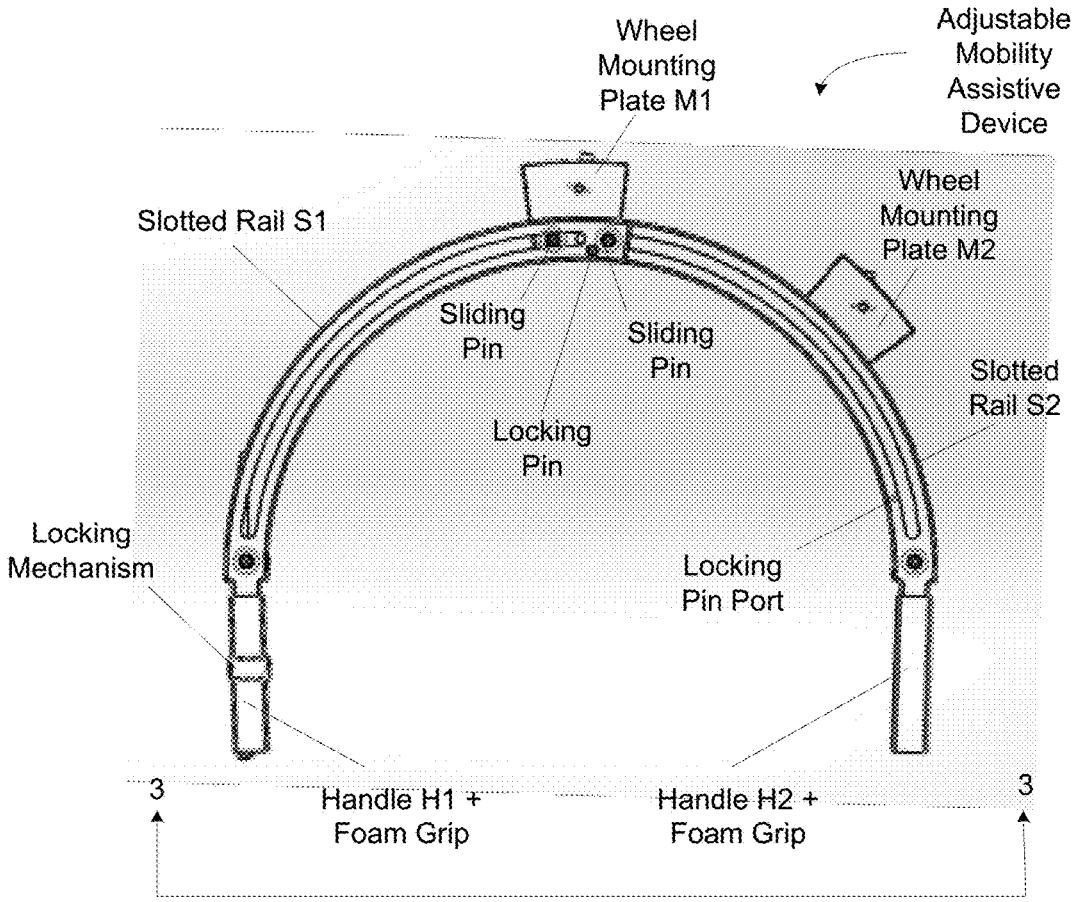
FIG. 2 is one example of a top view of an adjustable mobility assistive device in a fully extended position, in accordance with various embodiments.
Figure 3:
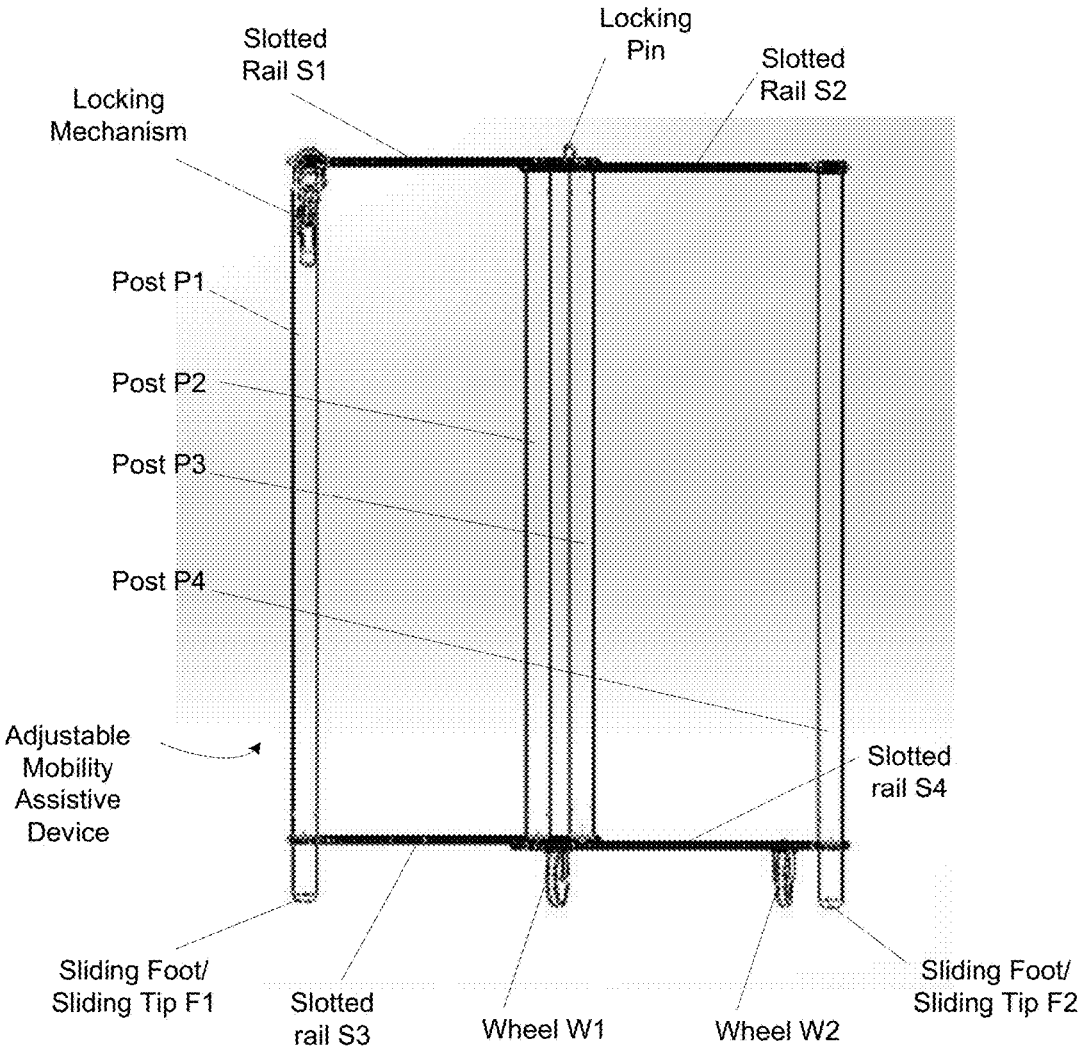
FIG. 3 is one example of a back facing view of an adjustable mobility assistive device in a fully extended position, in accordance with various embodiments.

Various embodiments described herein relate to an adjustable mobility assistive device that provides greater maneuverability, especially in tight spaces, and improved transportability. FIGS. 1-3 show one example of an adjustable mobility device in a fully extended position.

According to various embodiments, a nesting circles design is shown that includes two curved slotted rails that slide on top of each other using the posts as tracking mechanisms within the slots of the slotted rails. In various embodiments, the two curved slotted rails are quarter circular. It should be noted that quarter circular slotted rails do not have to be exactly a quarter of a circle. In some instances, the slotted rails may be greater or less than quarter circular but are still referred to herein as quarter circular. The slotted rails do not need to be circular, and may be elliptical in shape. Specifically, the center posts, P2 and P3 slide within the slotted rails, using these slotted rails as tracks to guide them into either a fully extended position, retracted position, or a position somewhere between these two positions. As shown, the device is fully extended with two quarter circles joined at their ends to form a semi-circular frame. As described in more detail below with regard to FIGS. 4-5, these quarter circle slotted rails can collapse or slide into each other to form a retracted position. In addition, the slotted rails and posts can be made from any of a variety of materials, such as aluminum, composite materials, metals, plastics, pvc, etc. However, in various embodiments, lightweight materials may be preferred for ease of transport and maneuverability.

Various dimensions can be used for the slotted rails and posts, depending on the application. In one example, quarter-inch aluminum plating can be used for the upper and lower slotted rails, and one inch diameter aluminum tubing with 0.047 inch wall thickness can be used for the posts. The slots in the slotted rails can be formed by waterjetting half inch slots in the centers of each of the slotted rails, in some examples. Furthermore, the posts can be capped with polyoxymethylene plastic caps and friction between the rails and sliding posts can minimized by machining custom polyoxymethylene plastic washers, in some examples. In addition, acrylic plastic tips or caps made of other materials can be placed at the bottom of the posts P1 and P4 in some instances.

According to various embodiments, wheels are mounted to one of the bottom slotted rails S4. By locating both wheels on one slotted rail, the wheels will not interfere when the adjustable mobility assistive device is moved into a retracted position as described in more detail below. With reference to FIG. 3, the wheels are shown mounted to slotted rail S4. In particular, with reference to FIG. 1, wheels W1 and W2 are mounted to wheel mounting plates M1 and M2, respectively. These wheel mounting plates are attached to slotted rail S4. The wheel mounting plates can include metal tabs protruding from the edge of slotted rail S4 to allow the wheels to be offset from the rails, in some examples. However, in various embodiments, wheels W1 and W2 can be mounted directly to or below slotted rail, depending on the application. When slotted rail S3 and post P3 slide over slotted rail S4, wheels W1 and W2 will stay out of the way of these moving parts. In addition, the wheels can be made of any appropriate material, such as rubber, urethane, silicone, silicone gel, composite materials, etc.

According to various embodiments, handles H1 and H2 extend from the upper slotted rails S1 and S2, respectively. These handles can be made of various materials, such as aluminum, metal, plastic, etc., depending on the application. According to various embodiments, grips can be added to the handles to increase comfort. These grips can be made from foam, gel, rubber, composite materials, etc.

In various embodiments, a locking mechanism can be included to stabilize the position of the slotted rails while in the fully extended position, retracted position, or some other desirable position. One example of a locking mechanism is shown in FIGS. 1-3. This locking mechanism includes components from a bicycle braking system. The brake lever is mounted on the left handle H1 with the cable extending to a locking pin at the end of slotted rail S1. Squeezing the handle releases the locking pin from the holes in the rail, allowing the rail to slide into other configurations. In some examples, a spring contained within a housing for the pin ensures that the locking pin slides into an available hole to lock the device. Such holes can be located at the fully extended position and the retracted position in some examples. For instance, with reference to FIG. 2, the locking pin is shown engaged with a hole in the fully extended position. Furthermore, a locking pin port is a hole that can be engaged in the retracted position. If locking positions between the fully extended position and the retracted position are desirable, additional holes or locking pin ports can be included.

If the adjustable mobility assistive device is to be used as a walker for the elderly, it may need to conform to certain standards, such as ISO standards. More particularly, static stability, defined as the maximum angle at which the walker can be tilted without tipping, or the minimum angle required to tip the walker, must reach the listed specifications to meet ISO standards (ISO 11199-2, 2003). According to the ISO standards of interest, the minimum tipping angles must be greater than 15 degrees in the forward direction (downhill), 7 degrees in the backwards direction (uphill) and 3.5 degrees in the sideways direction (ISO 11199-2). In one example, an adjustable mobility device can be designed with a downhill tip angle of 24.1 degrees, uphill tip angle of 19.7 degrees, and sideways tip angle of 14.6 degrees, when in the fully extended position.

Various embodiments of the adjustable mobility assistive device may also be designed to meet additional ISO requirements. For instance, the adjustable mobility assistive device can include a handgrip width greater than 20 mm, replaceable tips greater than 35 mm, a secure locking mechanism, and front wheel diameter greater than 75 mm. One example of a locking mechanism is described above. Other examples can include friction-based locking mechanisms that can be disengaged with a firm application of force or pressure. Yet other examples can include a locking pin that can be disengaged by pushing down directly on the pin (which can be rounded in some examples) and re-engaged when it "pops up" into a hole such as a locking pin port.

Figure 4:
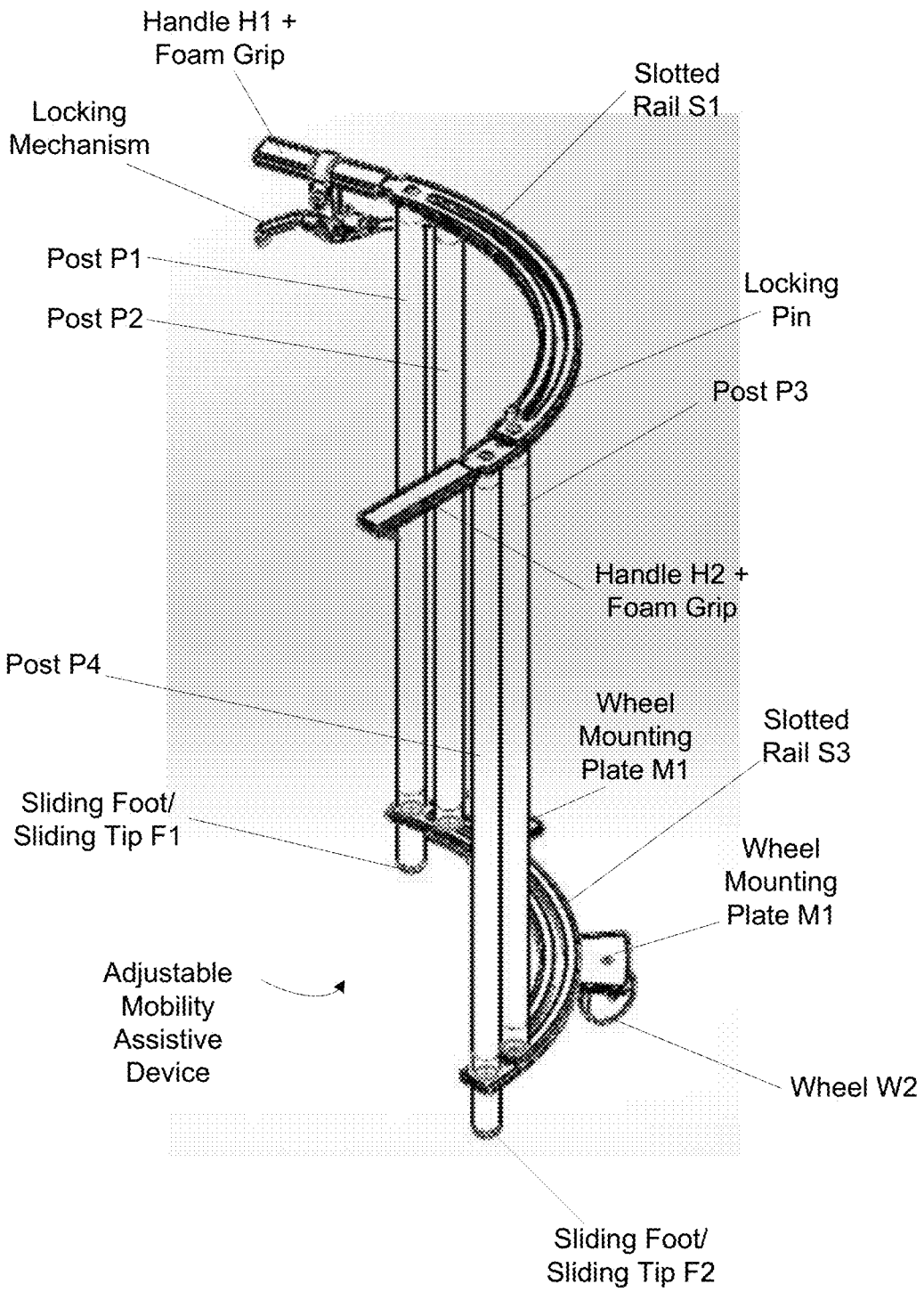
FIG. 4 is a diagrammatic representation of one example of an adjustable mobility assistive device in a retracted position, in accordance with various embodiments.
Figure 5:
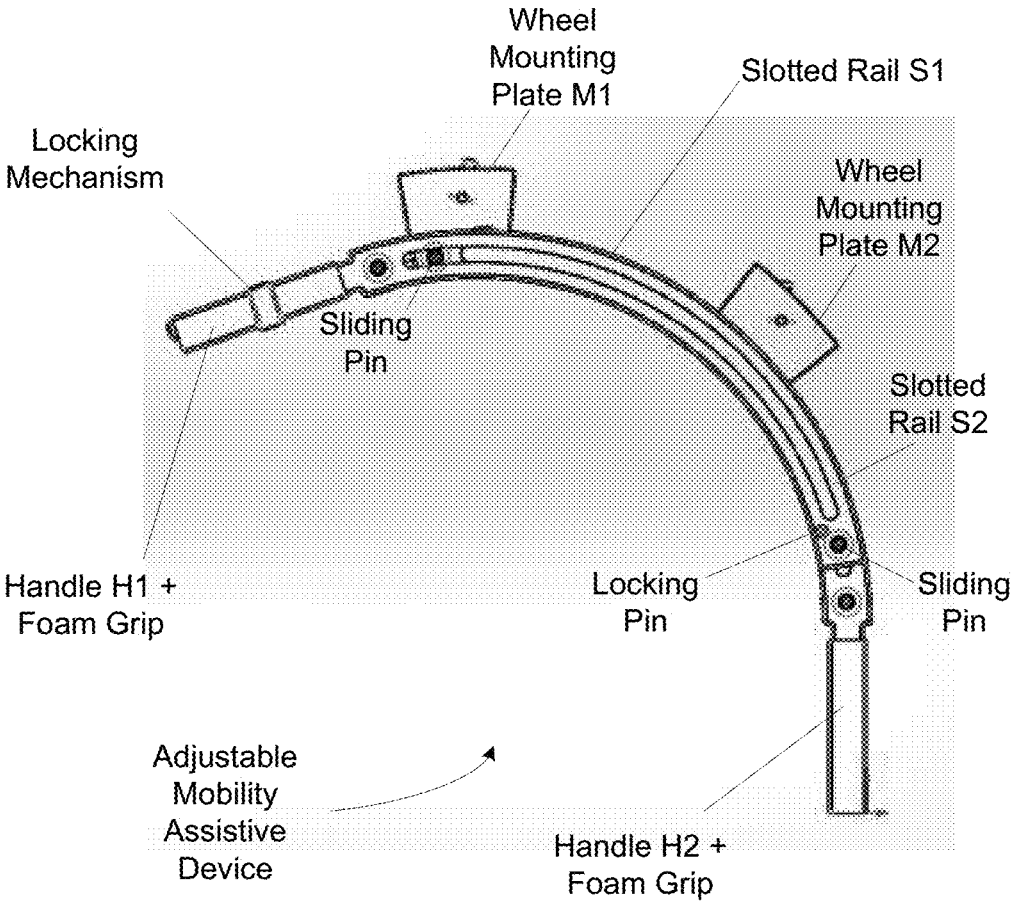
FIG. 5 is one example of a top view of an adjustable mobility assistive device in a retracted position, in accordance with various embodiments.

FIGS. 4-5 show one example of an adjustable mobility assistive device in a retracted position, according to various embodiments. With reference to FIG. 4, the locking pin has been released and the slotted rails been collapsed such that the two quarter circles overlap each other. Specifically, slotted rail S1 overlaps slotted rail S2 and slotted rail S3 overlaps S4. The sliding pins shown are mounted to their respective posts and allow the posts to slide relative to the slotted rails.

According to various embodiments, the locking pin engages with the locking pin port once the slotted rails reach a fully retracted position, as shown more clearly in FIG. 5. In various embodiments, the locking pin can engage in pin ports in additional positions. Alternatively, a locking mechanism can be included that allows a user to lock the device in any position between the fully extended and fully retracted positions.

According to various embodiments, the slotted rail system allows easy modification of the footprint of the device. Although many devices can be folded for transport, few devices have multiple functional configurations. An inherent trade-off between the size of the footprint and the stability of the device allows for only a small range of stable devices that can also be used in small spaces within the home. A device must be easily reconfigured if the user is expected to change the configuration many times throughout the day. According to various embodiments, a simple push or pull on the device handles can allow the device to move from a fully extended position to a retracted position, or vice versa. In one example, the posts are connected to half-inch diameter pins (sliding pins), which slide within the slotted rails. This sliding mechanism allows easy adjustment by a user and different usable configurations of the device that can be used to assist the user in different environments, such as tight spaces.

According to various embodiments, a continuous adjusting mechanism may enable a wider range of configurations, including a fully extended position, a retracted position, and positions in-between. Because of the semi-circular/quarter-circular frame of the adjustable mobility assistive device, the handles become a protruding extension of the top frame, providing an ergonomic handle that conforms to the natural positioning of the hands and joints when extended, and providing a more stable configuration when retracted.

As described above with regard to FIGS. 1-3, the posts and wheels must slide without interfering with one another. Accordingly, two wheels are mounted to one of the lower rails and two sliding tips are mounted on the rear posts. As also described above, the two wheels can be mounted directly to the bottom rail or can be mounted to a wheel mounting plate.

According to the ISO standards of interest, the minimum tipping angles must be greater than 15 degrees in the forward direction (downhill), 7 degrees in the backwards direction (uphill) and 3.5 degrees in the sideways direction (ISO 11199-2). In one example, the retracted position of the adjustable mobility assistive device can be designed with a downhill tip angle of 23.6 degrees, uphill tip angle of 23.6 degrees, and the sideways tip angle of 8.5 degrees. However, other dimensions can be used to yield different tip angles that conform to the ISO standards.

FIG. 1 depicts a diagrammatic representation of one example of an adjustable mobility assistive device 100 in a fully extended position, in accordance with various embodiments. FIG. 2 illustrates one example of a top view of an adjustable mobility assistive device 100 in a fully extended position, in accordance with various embodiments. FIG. 3 illustrates one example of a back facing view of an adjustable mobility assistive device 100 in a fully extended position, in accordance with various embodiments. FIG. 4 illustrates one example of an adjustable mobility assistive device 100 in a retracted position, in accordance with various embodiments. FIG. 5 illustrates one example of a top view of an adjustable mobility assistive device 100 in a retracted position, in accordance with various embodiments. With reference to FIGS. 1-5, rail 101 (S1) is a curvilinear guide rail that may be constructed of aluminum or other strong, lightweight material. A slot runs down the center of rail 101. Rail 101 is connected to post 105 and 107, and the sliding pin 206 of post 106 moves through its slot. Rail 101 is slidably connected to rail 102, laying on top with a small portion of overlap. Rail 101 is attached to rail 103 via posts 105 and 107. Rail 101 extends into handle 109. Locking pin 118 passes through rail 101 into rail 102 and may land in locking pin port 219. According to various embodiments, the locking pin port is a hole is slotted rail S2 that the locking pin falls through when the mobility assistive device is in the retracted position, holding slotted rails S1 and S2 fixed in place relative to one another.

According to various embodiments, rail 102 (S2) is a curvilinear guide rail that may be constructed of aluminum or other strong, lightweight material. A slot runs down the center of rail 102. Rail 102 is connected to post 106 and 108, and the sliding pin 207 of post 107 moves through its slot. Rail 102 is slidably connected to rail 101, laying below with a small portion of overlap. Rail 102 is attached to rail 104 via posts 106 and 108. Rail 102 extends into handle 110. Locking pin 118 passes through rail 101 into rail 102.

Rail 103 (S3) may be a curvilinear guide rail that may be constructed of aluminum or other strong, lightweight material. In particular examples, a slot runs down the center of rail 103. Rail 103 is connected to post 105 and 107, and the sliding pin 206 of post 106 moves through its slot. Rail 103 is slidably connected to rail 104, laying on top with a small portion of overlap. Rail 103 is attached to rail 101 via posts 105 and 107. Rail 103 attaches to sliding foot 111.

In particular embodiments, rail 104 (S4) is a curvilinear guide rail that may be constructed of aluminum or other strong, lightweight material. A slot runs down the center of rail 104. Rail 104 is connected to post 106 and 108, and the sliding pin 207 of post 107 moves through its slot. Rail 104 is slidably connected to rail 103, laying below with a small portion of overlap. Rail 104 is attached to rail 102 via posts 106 and 108. Rail 104 attaches to sliding foot 112 and to wheel mounting plates 113 and 114, which are in turn attached to wheels 115 and 116, respectively.

Post 105 (P1) may be a straight hollow tube that may be constructed of aluminum or other strong, lightweight material which vertically connects rail 101 to rail 103. Post 106 (P2) may be a straight hollow tube that may be constructed of aluminum or other strong, lightweight material which vertically connects rail 102 to rail 104 and moves through the slots of rail 101 and rail 103 via attached metal sliding pins on each side.

According to various embodiments, post 107 (P3) is a straight hollow tube that may constructed of aluminum or other strong, lightweight material which vertically connects rail 101 to rail 103 and moves through the slots of rail 102 and rail 104 via attached metal sliding pins on each side. In particular embodiments, post 108 (P4) is a straight hollow tube that may constructed of aluminum or other strong, lightweight material which vertically connects rail 102 to rail 104.

In particular examples, Handle 109 (H1) extends out of rail 101 and is made of the same material. Handle 109 is covered in a grip and attached to the locking mechanism. The grip can be made from foam, gel, rubber, composite materials, and other materials that provide a soft, high friction surface. Handle 110 (H2) extends out of rail 102. Handle 110 is covered in a grip. The grip can be made from foam, gel, rubber, composite materials, and other materials that provide a soft, high friction surface.

Sliding foot 111 (F1) is connected to rail 103 and transfers weight to the ground. Sliding foot 111 is made out of hollow or solid tubing constructed of aluminum or other strong, lightweight material. Sliding foot 112 (F2) is connected to rail 104 and transfers weight to the ground. Sliding foot 112 is made out of hollow or solid tubing constructed of aluminum or other strong, lightweight material.

According to various embodiments, wheel mounting plate 113 (M1) is attached to rail 104, can be made of the same material as rail 104, and attaches to wheel 115. Similarly, wheel mounting plate 114 (M2) is attached to rail 104, can be made of the same material as rail 104, and attaches to wheel 116. Wheel 115 (W1) rolls on the ground, transfers weight to the ground, and attaches to wheel mounting plate 113. Wheel 115 can be made of any appropriate material, such as rubber, urethane, silicone, composite materials, etc. Wheel 116 (W2) rolls on the ground, transfers weight to the ground, and attaches to wheel mounting plate 114. Wheel 116 can be made of any appropriate material, such as rubber, urethane, silicone, composite materials, etc.

In particular embodiments, locking mechanism 117 attaches to handle 109 and is connected to locking pin 118 by bicycle break cable along rail 101. The locking mechanism is a standard bicycle break, and squeezing the lever pulls on the locking pin. Locking pin 118 is placed in holes in rail 101 and rail 102, holding them in place relative to each other. Locking pin 118 is inside a housing and connected to locking mechanism 117 by bicycle brake cable. Squeezing the lever of locking mechanism 118 lifts locking pin 118 and allows rail 101 and 102 to slide relative to one another. Locking pin 118 may be made of any rigid metal, with materials that are more easily machined, such as brass, being preferable.

According to various embodiments, an adjustable mobility assistive device 100 can be used in various environments. For instance, a user can easily use the adjustable mobility assistive device 100 in everyday surroundings, but can additionally adjust the device to fit into tight spaces that might otherwise not fit a standard mobility assistive device, such as a walker. These tight spaces commonly occur in the home environment, but could also occur in many outside environments, such as within stores, public restrooms and stalls, doorways, queues, etc.

Figure 6:
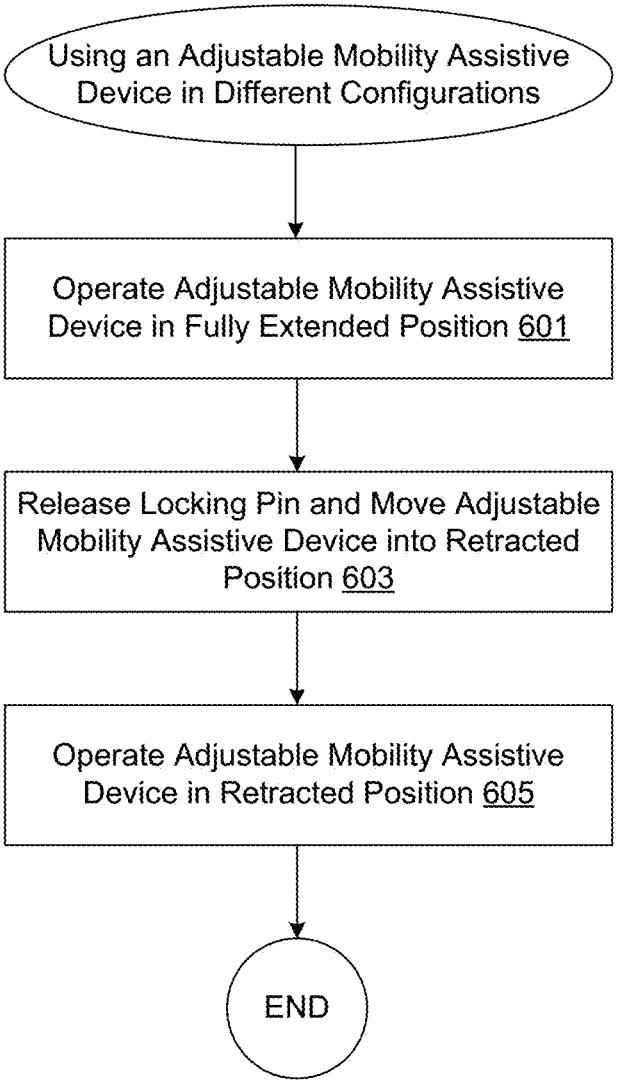
FIG. 6 is one example of a process of using an adjustable mobility assistive device in different configurations, in accordance with various embodiments.

With reference to FIG. 6, shown is one example of a process of using an adjustable mobility assistive device in different configurations. In particular, the mobility assistive device can be used in a fully extended position at 601. According to various embodiments, this position may provide the very stable configuration for the user when the user is walking or standing. In many instances, this position may become the default operating position to be used. However, when a user encounters a tight or difficult to navigate environment, a smaller configuration of the device may be desirable.

When the user wants to move the device into a retracted position, the user can release the locking pin and move the adjustable mobility assistive device into a retracted position at 603. According to various embodiments, the adjustable mobility assistive device can be adjusted with one swift and easy motion of the arms. This adjustment method may be received favorably among the elderly suffering from arthritis that affects the joints of the extremities. Once the adjustable mobility assistive device is locked into a retracted position, the device can be operated in this retracted position by the user at 605. By having a smaller footprint, the device can move with the user into more environments and help prevent falls. When the user would like to expand the mobility assistive device into a fully extended position, the user can release the locking pin again, and pull the handles apart in a swift motion to move it back into a fully extended position.

The adjustable mobility assistive device provides various advantages over traditional mobility assistive devices such as walkers or canes. In particular, the adjustable mobility assistive device is adjustable such that it functions in many positions and throughout various environments, such as a home environment, unlike traditional walkers. Specifically, the adjustable mobility assistive device can fit through doorways and around corners, unlike traditional walkers. Although traditional canes provide transportability and can easily fit through doorways, around corners, and tight spaces, traditional canes provide less stability and support to a user during a fall than the adjustable mobility assistive device. In addition, the adjustable mobility assistive device can be used in a standing or walking position.

Figure 7:
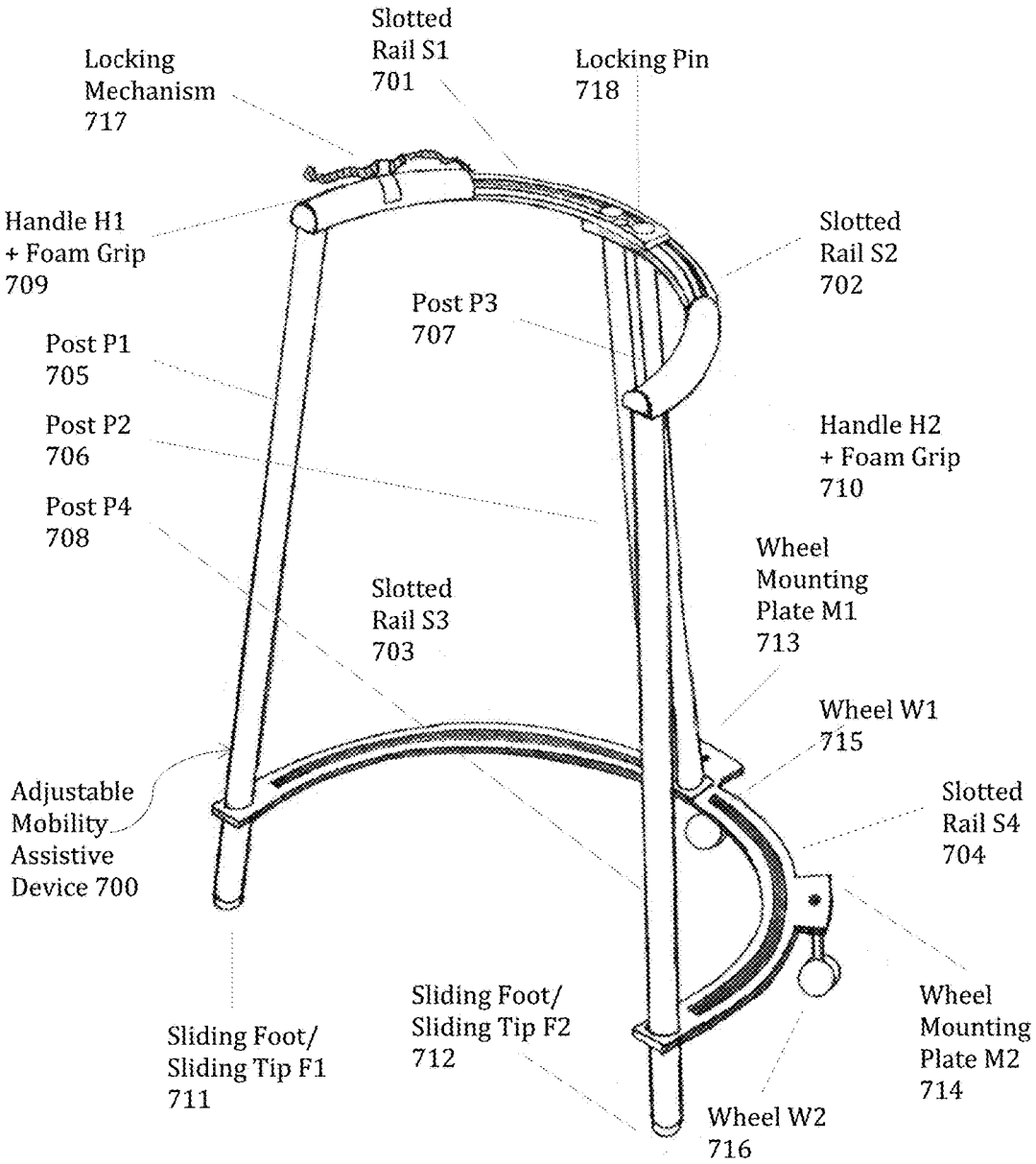
FIG. 7 is a diagrammatic representation of one example of an adjustable mobility assistive device in a fully extended position, in accordance with various embodiments.
Figure 8:
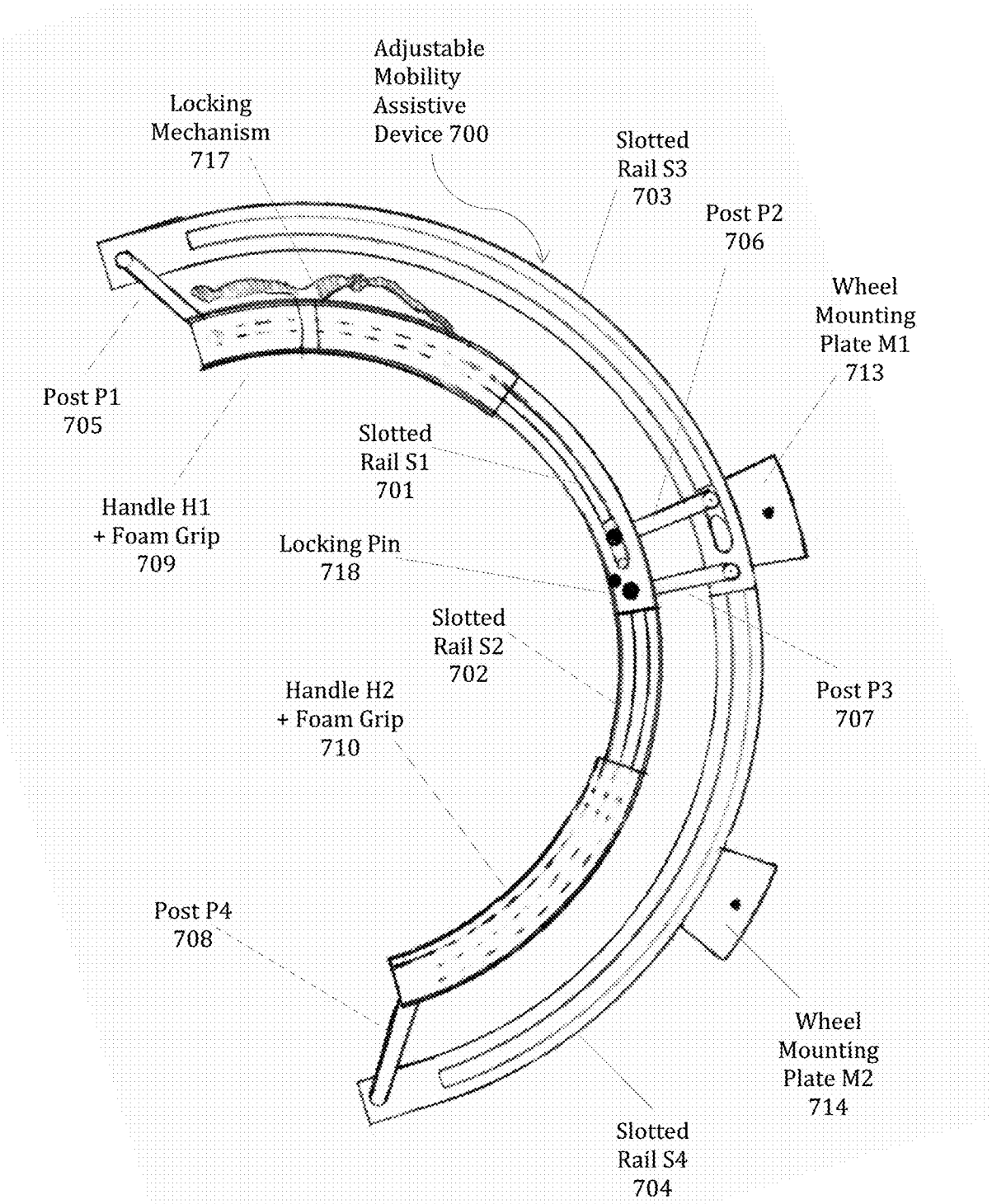
FIG. 8 is one example of a top view of an adjustable mobility assistive device in a fully extended position, in accordance with various embodiments.
Figure 9:
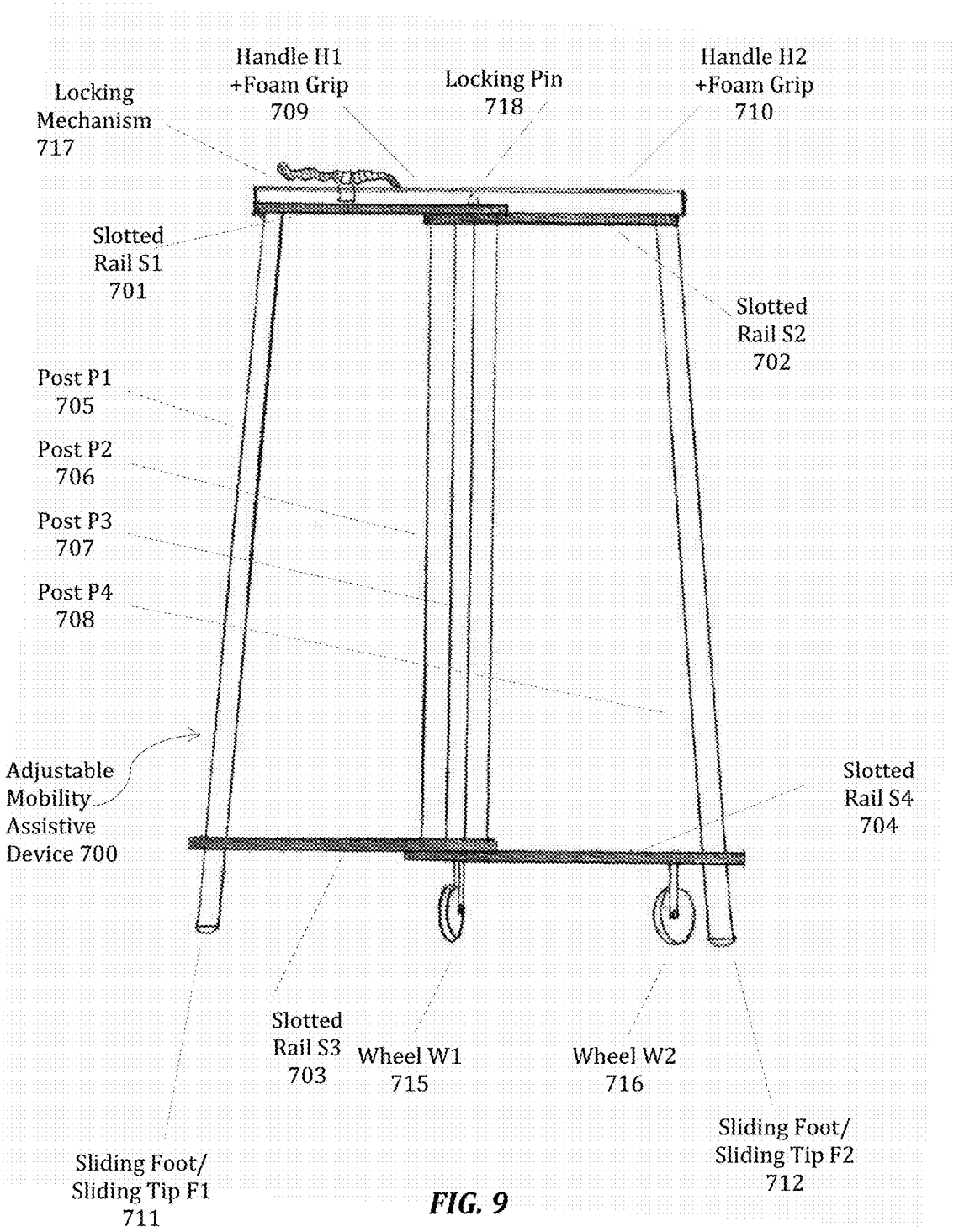
FIG. 9 is one example of a back facing view of an adjustable mobility assistive device in a fully extended position, in accordance with various embodiments.
Figure 10:
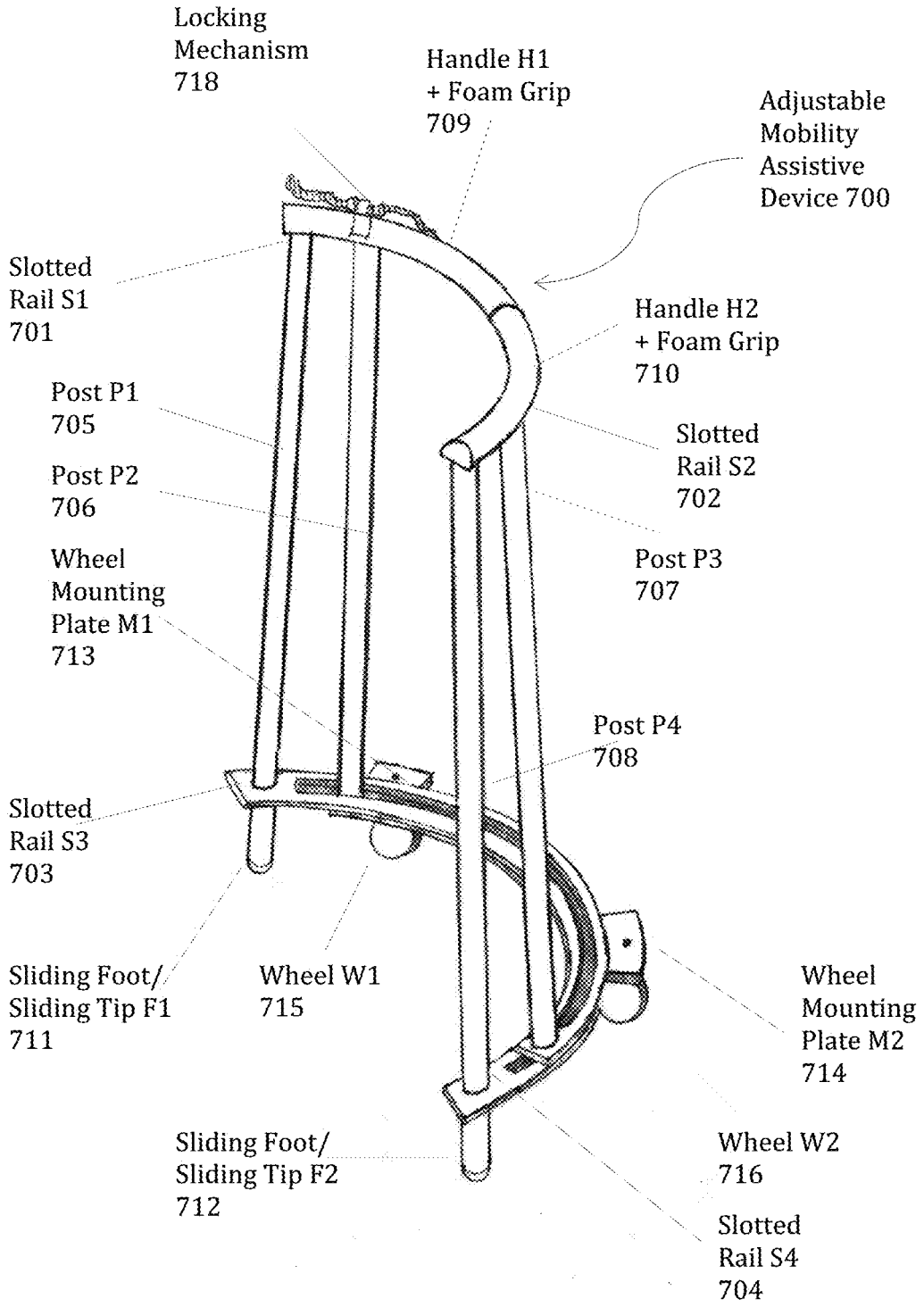
FIG. 10 is a diagrammatic representation of one example of an adjustable mobility assistive device in a retracted position, in accordance with various embodiments.
Figure 11:
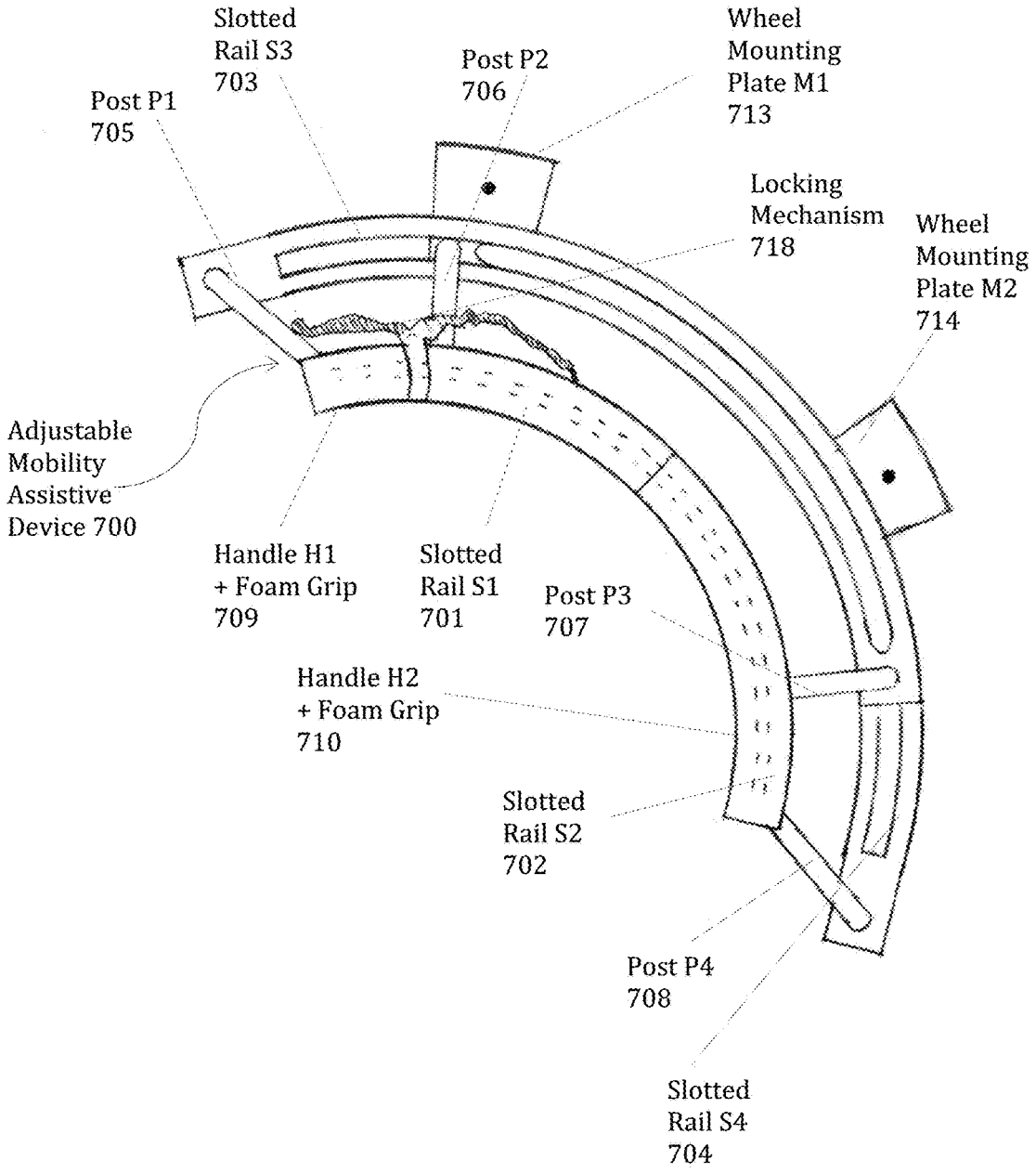
FIG. 11 is one example of a top view of an adjustable mobility assistive device in a retracted position, in accordance with various embodiments.

FIG. 7 depicts a diagrammatic representation of one example of an adjustable mobility assistive device 700 in a fully extended position, in accordance with various embodiments. FIG. 8 illustrates one example of a top view of an adjustable mobility assistive device 700 in a fully extended position, in accordance with various embodiments. FIG. 9 illustrates one example of a back facing view of an adjustable mobility assistive device 700 in a fully extended position, in accordance with various embodiments. FIG. 10 illustrates one example of an adjustable mobility assistive device 700 in a retracted position, in accordance with various embodiments. FIG. 11 illustrates one example of a top view of an adjustable mobility assistive device 700 in a retracted position, in accordance with various embodiments.

With reference to FIGS. 7-11, according to various embodiments, rail 701 (S1) is a curvilinear guide rail that may be constructed of aluminum or other strong, lightweight material. A slot runs down the center of rail 701. Rail 701 is connected to post 705 and 707, and the post 706 moves through its slot. Rail 701 is slidably connected to rail 702, laying on top with a small portion of overlap. Rail 701 is attached radially inward, above and in a concentric manner to rail 703 via posts 705 and 707. Rail 701 is partially covered by handle 709. Locking pin 718 passes through rail 701 into rail 702. According to various embodiments, rail 702 (S2) is a curvilinear guide rail that may be constructed of aluminum or other strong, lightweight material. A slot runs down the center of rail 702. Rail 702 is connected to post 706 and 708, and the post 707 moves through its slot. Rail 702 is slidably connected to rail 701, laying below with a small portion of overlap. Rail 702 is attached radially inward, above and in a concentric manner to rail 704 via posts 706 and 708. Rail 702 is partially covered by handle 710. Locking pin 718 passes through rail 701 into rail 702.

In particular embodiments, rail 703 (S3) is a curvilinear guide rail that may be constructed of aluminum or other strong, lightweight material. A slot runs down the center of rail 703. Rail 703 is connected to post 705 and 707, and the sliding pin of post 706 moves through its slot. Rail 703 is slidably connected to rail 704, laying on top with a small portion of overlap. Rail 703 is attached radially outward, below and in a concentric manner to rail 701 via posts 705 and 707. Rail 703 attaches to sliding foot 711.

According to various embodiments, rail 704 (S4) is a curvilinear guide rail that may be constructed of aluminum or other strong, lightweight material. A slot runs down the center of rail 704. Rail 704 is connected to post 706 and 708, and the post 707 moves through its slot. Rail 704 is slidably connected to rail 703, laying below with a small portion of overlap. Rail 704 is attached radially outward, below and in a concentric manner to rail 702 via posts 706 and 708. Rail 704 attaches to sliding foot 712 and to wheel mounting plates 713 and 714, which are in turn attached to wheels 715 and 716, respectively.

In particular embodiments, post 705 (P1) is a straight hollow tube that may be constructed of aluminum or other strong, lightweight material which connects rail 701 to rail 703 at an angle in a concentric manner.

In particular examples, post 706 (P2) is a straight hollow tube that may be constructed of aluminum or other strong, lightweight material which connects rail 702 to rail 704 at an angle in a concentric manner and moves through the slots of rail 701 and rail 703 via attached metal sliding pins on each side. Acve, post 707 (P3) is a straight hollow tube that may constructed of aluminum or other strong, lightweight material which connects rail 701 to rail 703 at an angle in a concentric manner and moves through the slots of rail 702 and rail 704 via attached metal sliding pins on each side.

Acve, post 708 (P4) is a straight hollow tube that may constructed of aluminum or other strong, lightweight material which connects rail 702 to rail 704 at an angle in a concentric manner.

Handle 709 (H1) is a curved half-pipe attached over the top of rail 701 by its edges and can be made of bent PVC or other lightweight material. Handle 709 is covered in a grip and attached to the locking mechanism. The grip can be made from foam, gel, rubber, composite materials, and other materials that provide a soft, high friction surface.

Handle 710 (H2) is a curved half-pipe attached over the top of rail 702 by its edges and can be made of bent PVC or other lightweight material. Handle 710 is covered in a grip. The grip can be made from foam, gel, rubber, composite materials, and other materials that provide a soft, high friction surface.

According to various embodiments, sliding foot 711 (F1) is connected to rail 703 and transfers weight to the ground. Sliding foot 711 is made out of hollow or solid tubing constructed of aluminum or other strong, lightweight material. Sliding foot 712 (F2) is connected to rail 704 and transfers weight to the ground. Sliding foot 712 is made out of hollow or solid tubing constructed of aluminum or other strong, lightweight material.

Wheel mounting plate 713 (M1) is attached to rail 704, can be made of the same material as rail 704, and attaches to wheel 715. Wheel mounting plate 714 (M2) is attached to rail 704, can be made of the same material as rail 704, and attaches to wheel 716. Wheel 715 (W1) rolls on the ground, transfers weight to the ground, and attaches to wheel mounting plate 713. Wheel 715 can be made of any appropriate material, such as rubber, urethane, silicone, composite materials, etc.

In particular embodiments, wheel 716 (W2) rolls on the ground, transfers weight to the ground, and attaches to wheel mounting plate 714. Wheel 716 can be made of any appropriate material, such as rubber, urethane, silicone, composite materials, etc.

Locking mechanism 717 attaches to handle 709 and is connected to locking pin 718 by bicycle break cable along rail 701. The locking mechanism is a standard bicycle break, and squeezing the lever pulls on the locking pin. Locking pin 718 is placed in holes in rail 701 and rail 702, holding them in place relative to each other. Locking pin 718 is inside a housing and connected to locking mechanism 717 by bicycle brake cable. Squeezing the lever of locking mechanism 718 lifts locking pin 718 and allows rail 701 and 702 to slide relative to one another. Locking pin 718 may be made of any rigid metal, with materials that are more easily machined, such as brass, being preferable.

According to various embodiments, an adjustable mobility assistive device 700 can be used in various environments. For instance, a user can easily use the adjustable mobility assistive device 700 in everyday surroundings, but can additionally adjust the device to fit into tight spaces that might otherwise not fit a standard mobility assistive device, such as a walker. These tight spaces commonly occur in the home environment, but could also occur in many outside environments, such as within stores, public restrooms and stalls, doorways, queues, etc.

According to various embodiments, the adjustable mobility assistive device provides benefits in 1) maneuverability, 2) ease of adjusting, 3) portability and versatility, 4) comfort, and 5) stability in the smallest configuration. First, the adjustable mobility assistive device provides maneuverability. In particular, the device can operate throughout many environments of the home. For instance, the device can be used in the kitchen, which is typically a dangerous space, and bathroom, where many falls occur. The device can also maneuver over thresholds, which can include uneven flooring. Additionally, the device can function on stairs.

Second, the adjustable mobility assistive device is easy to adjust. In particular, the device operates with minimal input from the user. Moving the device between a fully extended position and a retracted position requires only an easy, swift movement of the arms. In addition, the device only requires one person to set up quickly and easily. Because many elderly individuals want to be more independent, this ease of setup and adjustment by the user alone provides a significant advantage.

Third, the adjustable mobility assistive device is portable and versatile. In particular, the device is lightweight. This helps because some users need to lift their devices while transporting them. In addition, the device can fit through doorways, hallways, and other tight spaces. Furthermore, the device can fit in a car trunk.

Fourth, the device is comfortable during use. In particular, the device is compatible with ergonomic body positions. This can be contrasted to a cane that may provide an uncomfortable wrist position. In addition, the device takes advantage of the user's physical strengths. For instance, for users whose arms are strong and legs are weak, the device leverages these physical attributes.

Fifth, the device provides stability even in its retracted position. Preventing falls requires both strength and balance. According to various embodiments, the device provides stability despite the user's lack of strength or balance. Specifically, the device catches the user without any interaction from the user. In addition, the device requires minimal coordination. In particular, the device prevents falls before the user knows they are falling. During a fall itself, users often claim that moments during a fall were much harder to recall than those shortly after a fall. For instance, users may experience an inability to be cognizant during a fall and even if they realize that they are falling, they cannot coordinate with a device that they are using to catch themselves.

CONCLUSION

Although the foregoing concepts have been described in some detail for purposes of clarity of understanding, it will be apparent that certain changes and modifications may be practiced within the scope of the appended claims. It should be noted that there are many alternative ways of implementing the processes, systems, and apparatuses. Accordingly, the present embodiments are to be considered as illustrative and not restrictive.

What is claimed is:

1. An adjustable mobility assistive device comprising:

a first frame including a first slotted rail (S1) and a second slotted rail (L) (S3) coupled by a first post (P1) and a second post (P3), wherein the first slotted rail (S1) is curved in shape and wherein the second slotted rail (S3) is curved in shape; and a second frame including a third slotted rail (S2) and a fourth slotted rail (S4) coupled by a third post (P2) and a fourth post (P4), wherein the third slotted rail (S2) is curved in shape and wherein the fourth slotted rail (S4) is curved in shape, wherein the third post (P2) is slidably connected to the first slotted rail (S1) and the second slotted rail (S3), wherein the second post (P3) is slidably connected to the third slotted rail (S2) and the fourth slotted rail (S4), wherein the third post (P2) is adjacent to the second post (P3) when in a first extended position, wherein the first post (P1) is adjacent to the third post (P2) and the second post (P3) is adjacent to the fourth post (P4) in a first retracted position, and wherein the third slotted rail (S2) is slidably moved relative to the first slotted rail (S1), and the fourth slotted rail is slidably moved relative the second slotted rail (S3).

2. The adjustable mobility assistive device of claim 1, wherein the first slotted rail (S1) is a curvilinear guide rail having a slot running down a center of the first slotted rail (S1).

3. The adjustable mobility assistive device of claim 1, wherein the first slotted rail (S1) is slidably connected to the third slotted rail (S2), wherein the first slotted rail (S1) lays on top of the third slotted rail (S2) with a portion of overlap.

4. The adjustable mobility assistive device of claim 3, wherein a locking pin passes through the first slotted rail (S1) to the third slotted rail (S2).

5. The adjustable mobility assistive device of claim 4, wherein a locking mechanism attaches to a handle and is connected to the locking pin.

6. The adjustable mobility assistive device of claim 5, wherein the locking pin is placed in holes in the first slotted rail (S1) and the third slotted rail (S2).

7. The adjustable mobility assistive device of claim 1, wherein the first post (P1), the second post (P2 P3), the third post (P3 P2), and the fourth post (P4) are straight hollow tubes.

8. The adjustable mobility assistive device of claim 1, wherein a handle (H1) extends out of the first slotted rail (S1) and is constructed from a material providing a soft, high friction surface.

9. The adjustable mobility assistive device of claim 1, wherein a handle (H2) extends out of the third slotted rail (S2) and is constructed from a material providing a soft, high friction surface.

10. The adjustable mobility assistive device of claim 1, wherein a sliding foot (F1) is connected to the second slotted rail (S3) and is constructed of hollow or solid tubing.

11. The adjustable mobility assistive device of claim 1, wherein a sliding foot (F2) is connected to the fourth slotted rail (S4) and is constructed of hollow or solid tubing.

12. The adjustable mobility assistive device of claim 1, wherein a wheel mounting plate (M1) is connected to the second slotted rail (S4 S3) and attaches to a wheel (W1).

13. The adjustable mobility assistive device of claim 1, wherein a wheel mounting plate (M2) is connected to the fourth slotted rail (S4) and attaches to a wheel (W2).

14. A system for adjustable mobility assistance comprising:

a first frame including a first slotted rail (S1) and a second slotted rail (S3) coupled by a first post (P1) and a second post (P3), wherein the first slotted rail (S1) is curved in shape and wherein the second slotted rail (S3) is curved in shape; and a second frame including a third slotted rail (S2) and a fourth slotted rail (S4) coupled by a third post (P2) and a fourth post (P4), wherein the third slotted rail (S2) is curved in shape and wherein the fourth slotted rail (S4) is curved in shape, wherein the first post (P2) is slidably connected to the first slotted rail (S1) and the second slotted rail (S3), wherein the second post (P3) is slidably connected to the third slotted rail (S2) and the fourth slotted rail (S4), wherein the third post (P2) is adjacent to the second post (P3) when in a first extended position, and wherein the first post (P1) is adjacent to the third post (P2) and the second post (P3) is adjacent to the fourth post (P4) in a first retracted position, and wherein the third slotted rail (S2) is slidably moved relative to the first slotted rail (S1), and the fourth slotted rail is slidably moved relative to the second slotted rail (S3).

15. The system of claim 14, wherein the first slotted rail (S1) is a curvilinear guide rail having a slot running down a center of the first slotted rail (S1).

16. The system of claim 14, wherein the first slotted rail (S1) is slidably connected to the third slotted rail (S2), wherein the first slotted rail (S1) lays on top of the third slotted rail (S2) with a portion of overlap.

17. The system of claim 16, wherein a locking pin passes through the first slotted rail (S1) to the third slotted rail (S2).

18. The system of claim 17, wherein a locking mechanism attaches to a handle and is connected to the locking pin.

19. The system of claim 18, wherein the locking pin is placed in holes in the first slotted rail (S1) and the third slotted rail (S2).

20. The system of claim 1, wherein the first post (P1), the second post (P2 P3), the third post (P3 P2), and the fourth post (P4) are straight hollow tubes.

* * * * *